US006655938B2

(12) United States Patent
Yanagisawa et al.

(10) Patent No.: US 6,655,938 B2
(45) Date of Patent: Dec. 2, 2003

(54) SCREW-TYPE DRY VACUUM PUMP HAVING AN ENLARGED CASING PORTION

(75) Inventors: Kiyoshi Yanagisawa, Tokyo (JP); Tokio Fukai, Bizen (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/985,529

(22) Filed: Nov. 5, 2001

(65) Prior Publication Data

US 2002/0057964 A1 May 16, 2002

(30) Foreign Application Priority Data

Nov. 10, 2000 (JP) ..... 2000-343870
Jul. 26, 2001 (JP) ..... 2001-226195

(51) Int. Cl.[7] ..... F04C 18/16; F04C 25/02
(52) U.S. Cl. ..... 418/201.1; 418/9; 418/46
(58) Field of Search ..... 418/9, 46, 201.1

(56) References Cited

U.S. PATENT DOCUMENTS 1,635,271 A * 7/1927 Hapgood ..... 418/46
4,004,864 A * 1/1977 Schibbye ..... 418/201.1
4,943,215 A * 7/1990 Berges ..... 418/46
5,051,077 A * 9/1991 Yanagisawa et al. .... 418/201.1
5,167,496 A * 12/1992 Jacobsson et al. ..... 418/201.1
6,371,744 B1 4/2002 Mito et al. ..... 418/201.3

FOREIGN PATENT DOCUMENTS

| | | | |
|---|---|---|---|
| FR | 1 409 698 A | 8/1965 | |
| JP | 62 093490 | 4/1987 | |
| JP | 02 245493 | 10/1990 | |
| JP | 4-171291 | * 6/1992 | ..... 418/9 |
| JP | 10 009163 | 1/1998 | |
| WO | WO 99 49220 A | 9/1999 | |

* cited by examiner

*Primary Examiner*—John J. Vrablik
(74) *Attorney, Agent, or Firm*—Westerman Hattori Daniels & Adrian, LLP

(57) ABSTRACT

A screw-type dry vacuum pump comprises a rotor having a screw thread thereon for exhausting a gas through rotation, a casing for housing the rotor therein, a reduced portion provided in the casing, and an enlarged portion provided on a discharge end of the casing. The reduced portion forms a slight gap between the outer circumferential surface of the rotor and the inner surface thereof. The enlarged portion forms a larger gap between the outer circumferential surface of the rotor and the inner surface thereof.

7 Claims, 3 Drawing Sheets

SCREW-TYPE DRY VACUUM PUMP HAVING AN ENLARGED CASING PORTION

BACKGROUND OF THE INVENTION

1. Field of the Invention

The present invention relates to a screw-type dry vacuum pump in which a rotor having a screw thread is disposed in a casing and rotated to discharge a gas from the pump.

2. Description of the Related Art

A conventional screw-type dry vacuum pump comprises, for example, two rotors each having a screw thread thereon, and slight gaps are formed between the two rotors and between a casing and each of the rotors. The two rotors are synchronously rotated in opposite directions, respectively, to transport a gas along the screw threads on the rotors. This type of pump has widely been used for exhausting a gas from a chamber in a semiconductor fabrication apparatus, for example.

In many semiconductor fabrication processes, a semiconductor wafer such as a silicon wafer is processed with use of a reactant gas in a semiconductor fabrication apparatus, such as a chemical vapor deposition (CVD) apparatus, a dry etching apparatus, or a sputtering apparatus, in which a vacuum environment is produced. A variety of processes, such as chemical vapor deposition, are performed in a chamber of the semiconductor fabrication apparatus. In some cases, process gases used in these processes contain solid materials or components that tend to be solidified. A screw-type dry vacuum pump, in which a rotor having a screw thread thereon is rotated to transport a gas, is suitable for exhausting these process gases through the rotation of the rotors. Solid materials that are accumulated in the screw threads and between the rotor and the casing are raked out and transported toward the discharge end through the rotation of the rotor.

FIG. 4 is a cross-sectional view showing a conventional screw-type dry vacuum pump, which is one type of dual shaft positive-displacement fluid machinery. The conventional screw-type dry vacuum pump comprises a cylindrical casing 11 and a rotatable rotor 12 having a screw thread thereon. The rotor 12 is housed in the casing 11 in such a state that a slight gap is formed between the outer circumferential surface of the rotor 12 and the inner surface of the casing 11. The rotor 12 is connected to a main shaft 15, which is supported by a bearing 16 fixed to a fixed member 13 on the discharge end. The main shaft 15 is coupled to an external motor (not shown), and hence the rotor 12 is rotated by actuation of the motor. A gas is introduced into the pump through an inlet port 17 by the rotation of the rotor 12. The gas is transported toward the discharge end along the rotating screw thread and then discharged from an outlet port 18.

The reactant gas to be discharged may contain solid materials. Accordingly, when the screw-type dry vacuum pump is used for exhausting a chamber of a semiconductor fabrication apparatus, for example, components in the reactant gas are solidified and accumulated on the discharge end of the rotor as reaction by-products 20 in some cases. As described above, in a screw-type dry vacuum pump, a rotor having a screw thread thereon is rotated to transport a gas, and solid materials that are accumulated in the pump can be raked out and transported toward the discharge end through the rotation of the screw thread. However, the gap formed between the rotor 12 and the casing 11 is filled with the reaction by-products 20 near the discharge end in the casing 11, as shown in the FIG. 4. When solid materials are accumulated on the discharge end of the vacuum pump to fill the gap formed between the rotor and the casing, an excessive load is imposed on the motor to stop the pump, causing damage to the pump and the motor.

The reactant gas to be discharged may contain agglomerates of reaction by-products, foreign matter, and the like. When the particle diameters of these solid materials are smaller than a gap between the rotors or a clearance between the rotor and the casing, the solid materials will be discharged by the evacuating operation of the rotors, as described above. However, when the particle diameters of the solid materials are larger, the solid materials may be caught in the gap between the rotors or the gap between the rotor and the casing in the evacuating process, hindering the rotation of the rotors.

SUMMARY OF THE INVENTION

The present invention has been made in view of the above drawbacks. It is therefore an object of the present invention to provide a vacuum pump which can prevent reaction by-products from being accumulated inside the pump.

According to a first aspect of the present invention, there is provided a screw-type dry vacuum pump comprising: a rotor having a screw thread thereon for exhausting a gas through rotation; a casing for housing the rotor therein; a reduced portion provided in the casing, the reduced portion forming a slight gap between the outer circumferential surface of the rotor and the inner surface thereof; and an enlarged portion provided on a discharge end of the casing, the enlarged portion forming a larger gap between the outer circumferential surface of the rotor and the inner surface thereof.

Since an enlarged portion, which forms a larger gap between the outer circumferential surface of the rotor and the inner surface thereof, is provided on a discharge end of the casing, a large gap is formed between the rotor and the casing on the discharge end. The present invention resolves the conventional problem that reaction by-products are accumulated in a fine gap between the rotor and the casing. Accordingly, the present invention ensures stable pump operations even when discharging a gas prone to generating solid reaction by-products.

According to a preferred aspect of the present invention, the vacuum pump further comprises an enlarged portion provided on a suction end of the casing, the enlarged portion forming a larger gap between the outer circumferential surface of the rotor and the inner surface thereof.

When the pump is provided with a plurality of rotors, a depression may be formed in the casing between the adjacent rotors to allow the accumulation of reaction byproducts.

According to another preferred aspect of the present invention, the vacuum pump further comprises a discharge mechanism for discharging reaction by-products that have been accumulated inside the casing. With this construction, reaction by-products can be discharged outside the pump when a large amount of by-products has been accumulated. Accordingly, this construction can prevent sudden stoppage of the vacuum pump and ensure stable operations of the pump.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

A screw-type dry vacuum pump according to preferred embodiments of the present invention will be described below with reference to the accompanying drawings.

Figure 1:
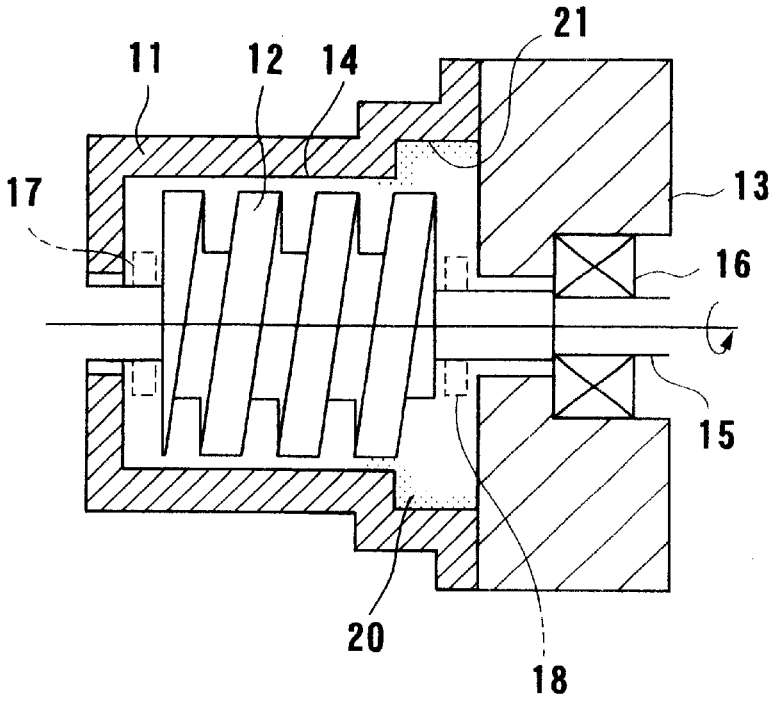
FIG. 1 is a cross-sectional view showing a screw-type dry vacuum pump according to a first embodiment of the present invention, taken along an axis of a rotating shaft.
Figure 4:
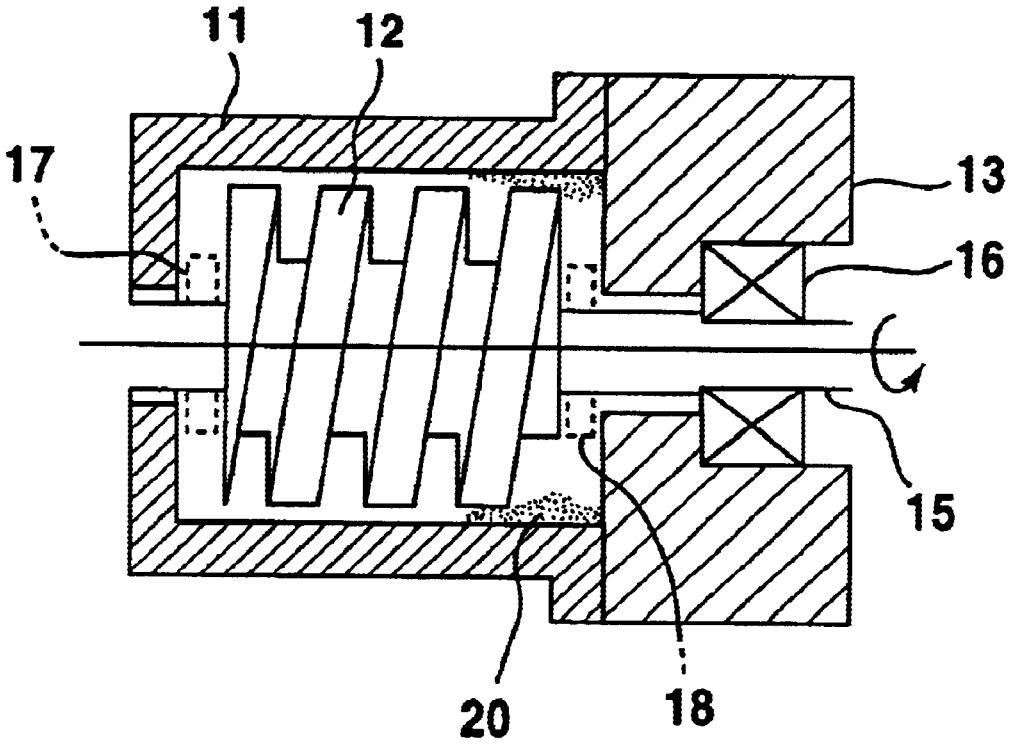
FIG. 4 PRIOR ART
FIG. 4 is a cross-sectional view showing a conventional screw-type dry vacuum pump, taken along an axis of a rotating shaft.

FIG. 1 is a cross-sectional view showing a screw-type dry vacuum pump having two rotors according to a first embodiment of the present invention, taken along an axis of one rotor. As with the conventional vacuum pump shown in FIG. 4, the screw-type dry vacuum pump according to the present embodiment comprises two rotors 12 each having a screw thread thereon, and main shafts (rotating shafts) 15 connected to the rotors 12. Each of the rotors 12 is rotated by actuation of a motor (not shown) to introduce a gas into the pump through an inlet port 17 and to transport the gas toward the discharge end. The gas is discharged from an outlet port 18 into the atmosphere. Thus, a chamber connected to the inlet port 17 of the vacuum pump is evacuated.

A casing 11 is disposed so as to cover the rotors 12 each having the screw thread thereon, and a slight gap is formed between the outer circumferential surface of the rotor 12 and the inner surface of the casing 11. The casing 11 is provided with a reduced portion 14 having an axial length shorter than the axial length of the rotors 12. Specifically, the casing 11 has the reduced portion 14 which forms the slight gap between the outer circumferential surface of the rotor 12 and the inner surface thereof, and an enlarged portion 21 formed on the discharge end of the casing 11. The enlarged portion 21 is arranged so as to form a larger gap between the outer circumferential surface of the rotor 12 and the inner surface thereof. The other configuration of the vacuum pump, such as a support mechanism mainly for supporting a main shaft 15 by a bearing 16 fixed to a fixing member 13, is the same as the configuration of the conventional vacuum pump shown in FIG. 4.

The reduced portion 14 of the casing 11 which forms the slight gap between the outer circumferential surface of the rotor 12 and the inner surface thereof has an axial length shorter than the portions of the rotors 12 that have the screw threads. Therefore, the dry vacuum pump according to the present invention resolves the conventional problem that reaction by-products in the exhaust gas are solidified and clog the discharge end of the rotors. Specifically, as described above, in the case where a vacuum chamber is evacuated in the semiconductor fabrication apparatus or the like, an exhaust gas may contain solidified materials or components that tend to be solidified. The dry vacuum pump according to the present invention is suitable for the use in such a situation.

Since the rotor 12 is positioned by the bearing 16 in the screw-type dry vacuum pump, the temperature at the discharge end tends to rise during operations. Further, the internal temperature on the discharge end tends to be increased by the heat of compression of the gas according to the rotation of the rotors 12. As a result, thermal expansions are caused in parts constituting the rotors on the discharge end. On the other hand, since the casing 11 is generally cooled by air cooling or the like, the fine gap between the outer circumferential surface of the rotor and the inner surface of the casing tends to grow smaller on the discharge end. Further, since the temperature near the outlet port is low, the vaporized reaction by-products 20 tend to be solidified near the outlet port. Therefore, the reaction by-products 20 transported from the upstream side of the pump have a tendency to be accumulated on the discharge end of the pump, as described above.

Generally, if solid materials are accumulated on the discharge end of the casing, then the accumulated materials are brought into contact with the outer circumferential surface of the rotor when the vacuum pump is stopped and the internal temperature of the pump is lowered. This results in an inability to restart the vacuum pump, as described above.

In the vacuum pump of the present invention, the reduced portion which forms the slight gap between the outer circumferential surface of the rotor 12 and the inner surface thereof does not extend over the discharge end of the rotors. Instead, the enlarged portion 21 is provided at the discharge end of the casing. With this construction, the vacuum pump of the present invention avoids the problem in the conventional vacuum pump that solid materials clog the discharge end of the rotor.

Specifically, since the gap between the outer circumferential surface of the rotor and the inner surface of the casing is expanded on the discharge end of the casing, reaction by-products contained in the exhaust gas are prevented from being accumulated and clogging this gap. The reaction by-products flow through the enlarged space and are discharged through the outlet port 18. Therefore, even when a gas containing reaction by-products is discharged, the reaction by-products are not accumulated on the discharge end of the casing. This can avoid the problems that the rotation of the rotor is hindered and an excessive load is imposed on the motor during start-up to cause damage to the rotor and the motor. As a result, the configuration of the present invention can lengthen life of the vacuum pump.

Figure 2:
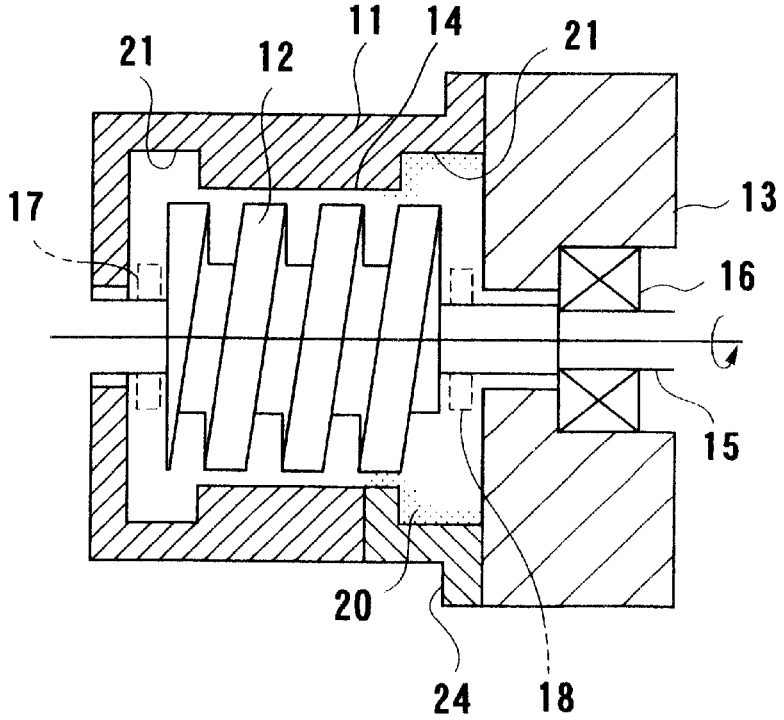
FIG. 2 is a cross-sectional view showing a screw-type dry vacuum pump according to a second embodiment of the present invention, taken along an axis of a rotating shaft.

A screw-type dry vacuum pump according to a second embodiment of the present invention will be described below with reference to FIG. 2. FIG. 2 is a cross-sectional view showing a screw-type dry vacuum pump according to the second embodiment, taken along an axis of a rotating shaft. The configuration and effects of the vacuum pump according to the second embodiment that are the same as those of the first embodiment will not be described below.

In the screw-type dry vacuum pump of the second embodiment, a casing 11 has a reduced portion 14 having an axial length shorter than the length of the rotors 12, and enlarged portions 21 provided not only at the discharge end but also at the suction end of the rotor. The enlarged portions 21 are arranged so as to form gaps between the outer circumferential surface of the rotor 12 and the inner surfaces thereof, and the gaps are larger than a gap between the outer circumferential surface of the rotor 12 and the inner surface of the reduced portion 14. Further, a detachable cover 24 is mounted over the enlarged portion 21 formed at the discharge end. The cover 24 serves as a discharge mechanism for discharging reaction by-products that have been accumulated in the enlarged portion 21. Although a bearing 16 is provided on the discharge end of the rotor in the present embodiment, a bearing can also be provided on the suction end in place of the bearing 16.

With this construction, even when reaction by-products and foreign matter having a large particle diameter flow into the pump, they are accumulated in the enlarged portion 21 provided at the suction end. Hence, the enlarged portion 21 at the suction end can prevent such reaction by-products from entering the rotating rotor 12, so that sudden stoppage of the pump can be forestalled.

Figure 3:
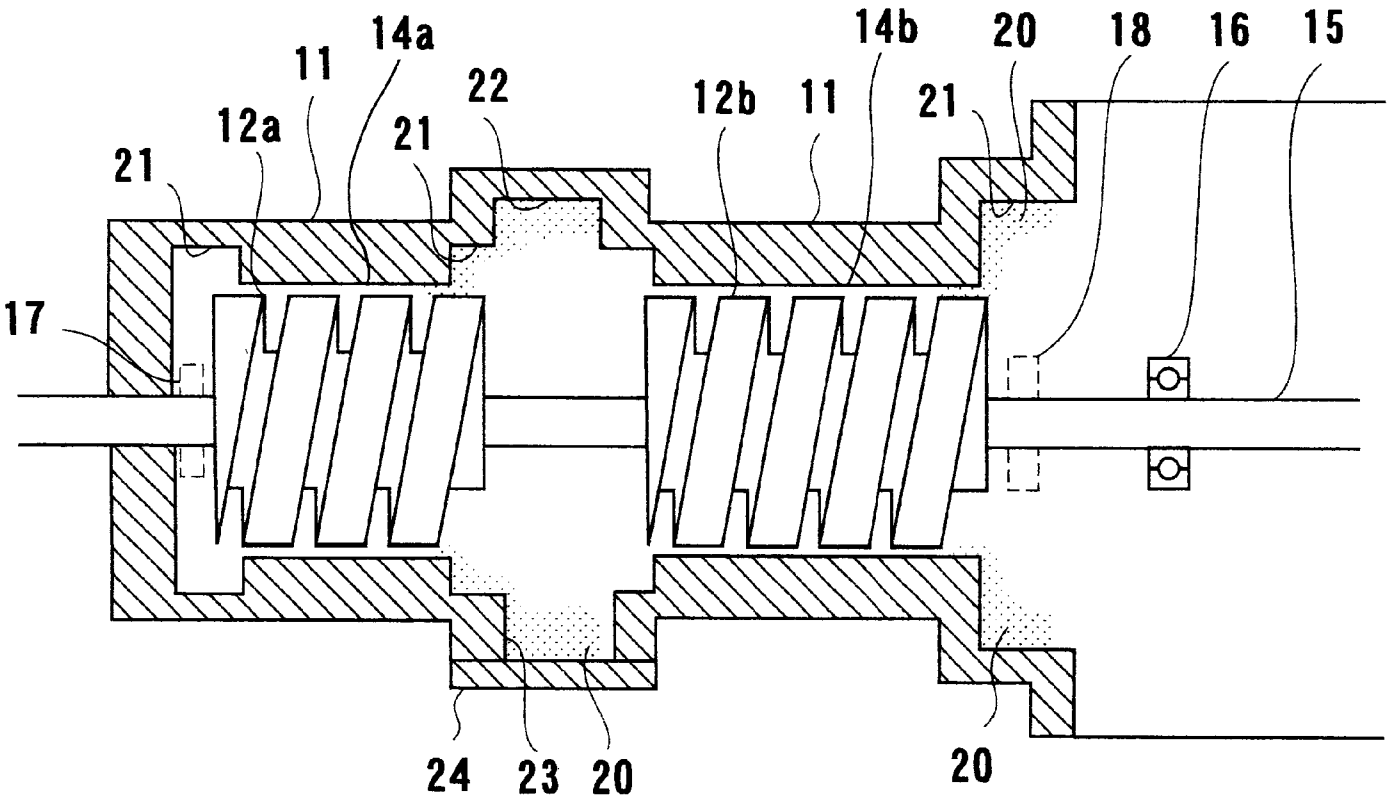
FIG. 3 is a cross-sectional view showing a screw-type dry vacuum pump according to a third embodiment of the present invention, taken along an axis of a rotating shaft.

A screw-type dry vacuum pump according to a third embodiment of the present invention will be described below with reference to FIG. 3. FIG. 3 is a cross-sectional view showing a screw-type dry vacuum pump according to the third embodiment, taken along an axis of a rotating shaft. The configuration and effects of the vacuum pump according to the third embodiment that are the same as those of the first and second embodiment will not be described below.

As shown in FIG. 3, the multistage screw-type dry vacuum pump of the third embodiment comprises two rotors 12*a* and 12*b* arranged in series on the main shaft 15. A casing 11 has reduced portions 14*a*, 14*b* having an axial length shorter than the axial length of the rotors 12*a*, 12*b*, respectively. Further, the casing 11 has enlarged portions 21 provided at the discharge end and the suction end of each of the rotors 12*a*, 12*b*. Specifically, three enlarged portions 21 are formed on an inlet port 17 end, on an outlet port 18 end, and between the two rotors 12*a*, 12*b*. A depression 22 is formed in the enlarged portion 21 located between the rotors 12*a* and 12*b*, and reaction by-products can be accumulated on the depression 22. A discharge port 23 is provided in the depression 22, and a cover 24 is provided for sealing the discharge port 23. The discharge port 23 and the cover 24 serve as a discharge mechanism for discharging from the casing 11 reaction by-products that have been accumulated in the depression 22. A discharge port and a cover can also be provided in the enlarged portion 21 formed on the outlet port 18 end for discharging reaction by-products. Further, although a bearing 16 is provided on the discharge end of the rotors in the present embodiment, a bearing can also be provided on the suction end in place of the bearing 16.

With this construction, reaction by-products 20 are transported toward the discharge end by the rotor 12*a* on the inlet port 17 end, and accumulated in the depression 22 prior to entering the rotor 12*b* on the outlet port 18 end. Therefore, the rotating rotors 12*a* and 12*b* can be prevented from being stopped, and hence stable operations of the pump can be achieved.

Through the passage of time, the amount of reaction by-products accumulated in the casing increases and the accumulated by-products gradually flow downstream. In this case, the reaction by-products may enter between the inner surface of the casing 11 and the outer circumferential surface of the rotors 12*a*, 12*b* to hinder the rotation of the rotors. With the configuration of the present embodiment, however, it is possible to discharge reaction by-products that have been accumulated in the depression 22 via the discharge port 23 and the cover 24. Accordingly, the present invention can ensure more stable pump operations and reduce the frequency at which the pump should be replaced. The use of this vacuum pump at semiconductor fabrication plants and the like can suppress damage to semiconductor products during production and can improve productivity.

While a screw-type dry vacuum pump having two rotors was described in the above embodiments, the present invention is not limited to these configurations and can obviously be applied to another form of a screw-type dry vacuum pump. Furthermore, the present invention can also be applied to a dry compressor having the same configuration as the aforementioned dry vacuum pump.

As described above, according to the present invention, solidified materials such as reaction by-products in an exhaust gas can be prevented from being accumulated inside the pump through a partial modification of the casing configuration. As a result, stable operations of the pump can be achieved, and life of the pump can be lengthened. Accordingly, the vacuum pump of the present invention is suitable for exhausting a gas that contains solid materials or components that tend to be solidified.

Although certain preferred embodiments of the present invention have been shown and described in detail, it should be understood that various changes and modifications may be made therein without departing from the scope of the appended claims.

What is claimed is:

1. A screw-type dry vacuum pump comprising:

a rotor having a screw thread thereon for exhausting a gas through rotation;

a casing for housing said rotor therein;

a reduced portion provided in said casing, said reduced portion forming a slight gap between the outer circumferential surface of said rotor and the inner surface thereof, an enlarged portion provided on a discharge end of said casing, said enlarged portion forming a larger gap around the entire circumference of said rotor between the outer circumferential surface of said rotor and the inner surface thereof, such that said larger gap can collect and trap by-product residue away from said rotor.

2. A screw-type dry vacuum pump according to claim 1, further comprising an enlarged portion provided on a suction end of said casing, said enlarged portion forming a larger gap between the outer circumferential surface of the rotor and the inner surface thereof.

3. A screw-type dry vacuum pump according to claim 1, further comprising a discharge mechanism for discharging reaction by-products that have been accumulated on said enlarged portion.

4. A screw-type dry vacuum pump according to claim 3, wherein said discharge mechanism comprises a discharge port and a cover, for detachably sealing the discharge port.

5. A screw-type dry vacuum pump comprising:

a plurality of rotors each having a screw thread for exhausting a gas through rotation, said plurality of rotors being arranged in a series;

a casing for housing said plurality of rotors; and a depression formed in said casing between the adjacent rotors, said depression provided with a discharge port and a cover for discharging accumulated reaction by products, an enlarged portion provided on a discharge end of said casing for each of said rotors, each said enlarged portion forming a larger gap around the entire circumference of said rotor between the outer circumferential surface of said rotor and the inner surface thereof, such that said larger gap can collect and trap by-product residue away from said rotor.

6. A screw-type dry vacuum pump according to claim 5, wherein said casing has a plurality of reduced portions having an axial length shorter than the axial length of the rotor.

7. A screw-type dry vacuum pump according to claim 5, wherein said casing has enlarged portions formed on inlet port ends of said rotors.

* * * * *